United States Patent [19]

Johnson et al.

[11] 4,233,023

[45] Nov. 11, 1980

[54] PHOTOFLASH LAMP HAVING EXPANDABLE BURNING VOLUME

[75] Inventors: Peter D. Johnson, Schenectady; Charles E. Jones, Clifton Park, both of N.Y.

[73] Assignee: General Electric Company, Schenectady, N.Y.

[21] Appl. No.: 958,653

[22] Filed: Nov. 8, 1978

[51] Int. Cl.[3] ..... F21K 5/00

[52] U.S. Cl. ..... 431/362

[58] Field of Search ..... 431/362, 358, 359

[56] References Cited

U.S. PATENT DOCUMENTS

| | | | |
|---|---|---|---|
| 2,277,482 | 3/1942 | DeMargitta | 431/362 |
| 2,981,088 | 4/1961 | Kaprelian | 431/362 |

*Primary Examiner*—Carroll B. Dority, Jr.

*Attorney, Agent, or Firm*—Marvin X. Snyder; James C. Davis

[57] ABSTRACT

A photoflash lamp of generally flat configuration for providing compact containment of metal fuel and solid oxidant includes a plate member having a recess therein. An expandable sheet member is formed over, and affixed to the plate surface adjacent to the recess for tightly containing a quantity of combustible material and solid oxidant within the recess. Ignition of the combustible material generates gaseous oxygen and reaction products which expands the sheet member away from the plate surface so as to provide an expandable volume to accommodate the burning oxygen-fuel mixture and to provide increased surface area for permitting maximum light emission.

14 Claims, 6 Drawing Figures

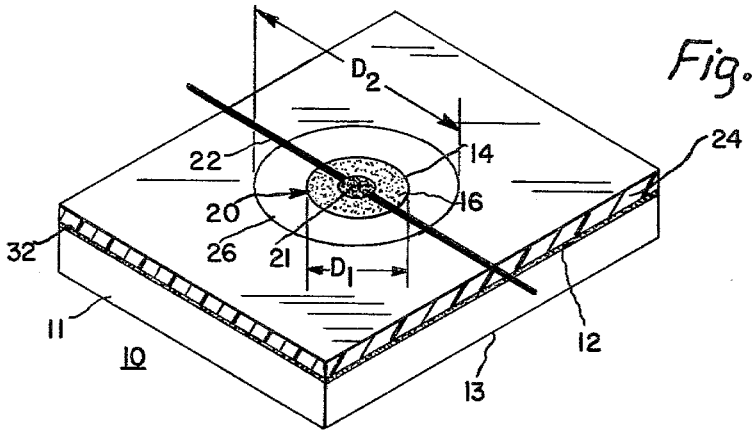
Fig. 1
Fig. 2
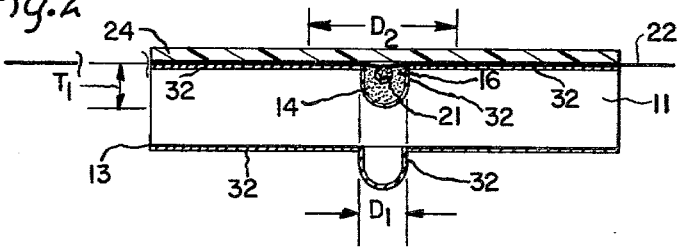
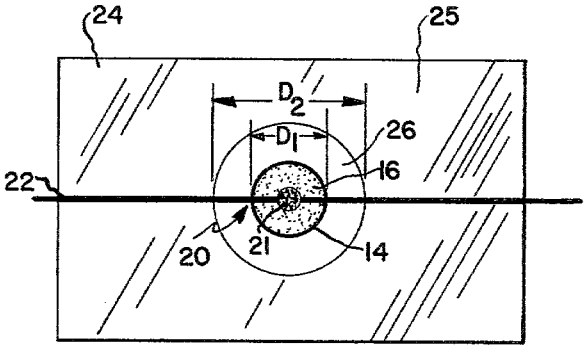
Fig. 3
Fig. 4
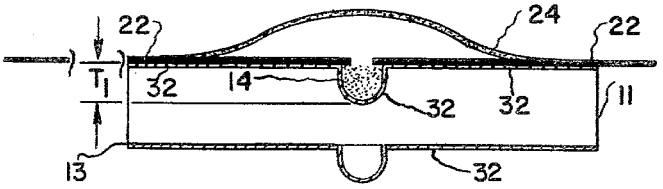

Fig.5
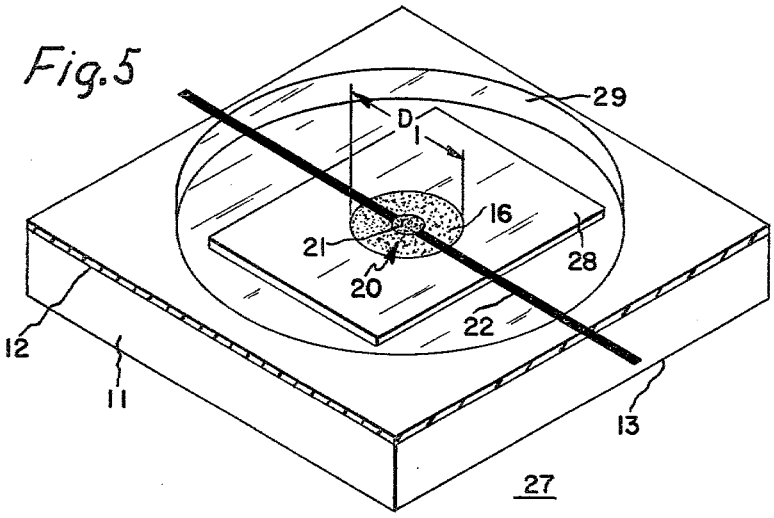
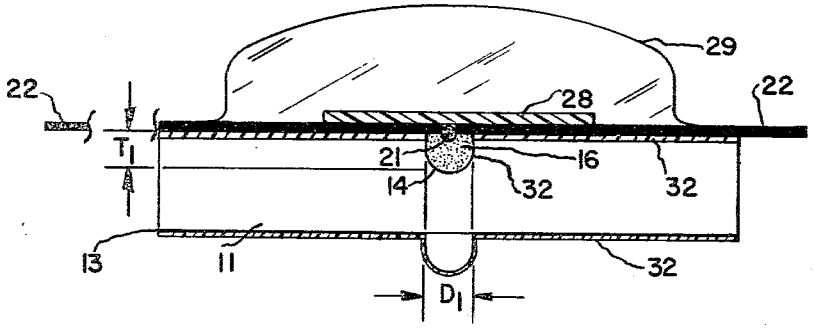
Fig.6

PHOTOFLASH LAMP HAVING EXPANDABLE BURNING VOLUME

FIELD OF THE INVENTION

This invention relates to a compact photoflash lamp containing combustible material, and more specifically to a photoflash lamp having an expandable structure for accommodation of the burning volume occupied by the oxygen-fuel mixture after ignition, thereby providing an expanded surface area for permitting maximum light radiation.

Conventional photoflash lamps are generally comprised of a volume of combustible metal such as zirconium or hafnium, a gaseous oxidant such as oxygen, and a primer for ignition of the combustible metal sealed together within a light transmitting envelop. The volume of the light transmitting envelope is chosen of sufficient magnitude for containing enough oxidant to consume most, if not all of the combustible metal. To reduce the size of such lamps, the oxidant is placed under high pressures, resulting in a potential hazard to the user.

If the volume of the light transmitting envelope is chosen too small, firm positive confinement of the combustible metal and oxidant may result in shattering or rupture of the envelope prior to ignition. Further, confinement of the combustible metal and gaseous oxidant in too small a volume provides inadequate surface area for sufficient emission of useful light radiation.

Although the above discussion has been confined to photoflash lamps containing a gaseous oxidant, the same drawback is present in photoflash lamps containing both a solid and a gaseous oxidant with the combustible metal deposited on the primer, such as the "speed-midget" photoflash lamp type. Photoflash lamps of this type are also subject to explosion or shattering as a result of the firm and positive confinement of the gaseous oxidant in a fixed volume.

The photoflash lamp of the present invention provides a compact structure for containing a dry powder mixture of metal fuel and solid oxidant, which structure expands during combustion to provide sufficient volume to accommodate the burning oxygen fuel mixture and reaction products.

SUMMARY OF THE INVENTION

Briefly, in accordance with the preferred embodiment of the present invention, a generally flat photoflash lamp comprises a plate member, such as a rigid polycarbonate plastic, provided with a recess in one surface thereof. A quantity of combustible metal fuel and solid oxidant substantially fills the volume of the recess. A primer overlies the surface of the plate member so as to be centrally disposed in the recess opening for ignition of the combustible material contained within the recess. A flexible, transparent, and heat or pressure expandable sealing sheet is formed over, and affixed to the plate surface adjacent to the recess periphery. Upon ignition, the sealing sheet expands so as to define a volume of predetermined magnitude between the sealing sheet and the plate surface greater than the initial volume of the combustible mixture contained within the recess to accommodate the burning volume required by the oxygen-fuel mixture and reaction products after ignition. An alternative embodiment includes a rigid enclosure affixed over the plate surface adjacent to the recess opening so as to define a combustion volume greater than the volume defined between the sealing sheet and plate surface before ignition.

It is an object of the present invention to provide a photoflash lamp having a minimal volume prior to ignition yet having an optimal burning volume and radiating area.

It is a further object of this invention to provide a photoflash lamp having reduced risk of violent lamp failure.

It is yet a further object of the present invention to provide a new and useful photoflash lamp capable of being fired during any spatial orientation.

BRIEF DESCRIPTION OF THE DRAWINGS

The features of the invention believed to be novel are set forth with particularity in the appended claims. The invention, itself, however, both as to organization and method of operation, together with further objects and advantages thereof, may best be understood by reference to the following description taken in conjunction with the accompanying drawings in which:

FIG. 1 is a perspective view of a generally flat photoflash lamp constructed in accordance with the teachings of the present invention;

FIG. 2 is a top view of the photoflash lamp of FIG. 1 showing the compact containment of combustible material and solid oxidant therein;

FIG. 3 is a front view of the photoflash lamp shown in FIGS. 1 and 2;

FIG. 4 is a top view of the photoflash lamp of FIGS. 1–3 after ignition, showing the expansion of the sealing sheet to accommodate the post ignition burning volume.

FIG. 5 is a perspective view of an alternative embodiment of the photoflash lamp of the invention, including a rigid enclosure formed over the surface of the plate member adjacent to the recess opening; and FIG. 6 is a top view of the photoflash lamp shown in FIG. 5.

DETAILED DESCRIPTION OF THE PREFERRED EMBODIMENTS

In FIGS. 1–4, there is shown a preferred embodiment of a generally flat photoflash lamp 10 according to the teachings of the present invention including a generally planar plate member 11 having first and second opposed surfaces 12 and 13, respectively. Plate member 11 is typically formed from a sheet of polycarbonate resin, such as Lexan (a registered trademark of General Electric Company) or a similar, substantially rigid, heat resistant plastic. Medially disposed in surface 12 of plate member 11 is a recess 14 having a diameter $D_1$. Recess 14 is typically formed by deforming surface 12 of plate member 11 to a depth $T_1$ and diameter $D_1$ as shown in FIG. 2 (the depth exaggerated for clarity of illustration).

A quantity 16 of combustible material and solid oxidant is disposed within recess 14 to a level which is substantially flush with surface 12 of plate member 11. The combustible material typically comprises one or more cumbustible metals, such as magnesium, aluminum, hafnium or thorium, in the form of shredded foil, granules, or powder, mixed together with a solid oxidant, typically chosen as a perchlorate or chlorate, such as $NaClO_3$ or $KClO_4$ and the like. A primer 20 is disposed across surface 12 and the opening of recess 14 for causing ignition of the combustible material disposed in the recess. Primer 20 includes a ball of solid primer material 21 comprised of a mixture of combustible metal and solid oxidant as described above, together with a pair of leads 22 affixed to, and extending from ball 21 across surface 12 of plate 11. Primer leads 22 may comprise either solid metallic conductors secured to, or thin foil leads sputtered on, surface 12 of plate member 11. When electric potential from a suitable source, such as a piezoelectric element or a battery, is applied to leads 22, primer ball 21 ignites and causes immediate combustion of combustible material in recess 14.

A pliable transparent heat or pressure expandable sheet member 24 is affixed to surface 12 as shown in FIG. 3. Sheet member 24 includes a sheet member seal area 25 rigidly secured about the periphery of recess 14 to surface 12 surrounding an annular expandable sheet member area 26 of a diameter $D_2$, being larger than $D_1$ of recess 14 adjacent to the recess. Expandable area 26 of sheet member 24 bears against the quantity 16 of combustible material and solid oxidant to insure compact containment within recess 14 prior to ignition.

In operation, primer 20, upon being electrically energized, initiates combustion of the combustible material within the recess, thus causing radiation of light energy and simultaneous release of gaseous oxygen and reaction products which forces expandable area 26 of sheet member 24 away from surface 12 of plate 11. The volume created by the expansion of expandable area 26 of sheet member 24 accommodates the burning fuel oxidant mixture and provides a more lambertian source of emission of light radiation.

As noted, the diameter $D_2$ of expandable area 26 is chosen larger than the diameter $D_1$ of recess 14. This allows the volume defined by the expansion of area 26 of sheet member 24 away from surface 12 of plate 11 to be considerably greater than the volume of recess 14 defined by $T_1$ and $D_1$. By choosing $D_2$ to be substantially greater than $D_1$, (e.g. $D_2=5D_1$), it has been found that maximum light output, together with an optimum burning time which typically may be in the range of 3 to 15 milliseconds will result from the combustion of the quantity 16 of combustible material. Sheet 24 is typically a pliable, laminar sheet of transparent plastic material having a yield strain in excess of 10% and ultimate elongation in excess of 5%. Transparent polyethylene plastic, such as Surlyn (a trademark of E.I. DuPont deNemours & Co.) or polypropylene, as well as plasticized polyvinyl chloride, have been found particularly well suited for this purpose. The typical thickness of sheet 24 is several mils. The pliability of expandable sheet 24 further reduces stress caused by the pressure resulting from the combustion of the fuel oxidant mixture thereby eliminating the risk of dangerous explosion.

An alternative embodiment of the photoflash lamp according to the present invention is shown in FIGS. 5 and 6 and is generally referenced by the numeral 27. Photoflash lamp 27 is comprised of a generally planar plate member 11 having a surface 12 provided with a recess 14 therein having an opening into surface 12. Recess 14, as seen in FIG. 6, has a diameter $D_1$ and depth $T_1$ wherein a quantity 16 of combustible material and solid oxidant is contained. A primer 20, disposed across surface 12, includes a ball of primer material 21 attached to leads 22 and is located at the opening of recess 14 in order to ignite the combustible material contained therein. A transparent shield 28 is secured in face-to-face relationship with surface 12 of plate member 11 and covers the opening of recess 14 so as to confine the quantity 16 of combustible material and solid oxidant within recess 14. Shield 28 may be formed from a sheet of pliable, transparent, heat-or-pressure expanding laminar plastic material, such as polyethylene or Surlyn. However, shield 28 need not necessarily be heat or pressure expandable. As will be explained in greater detail below, shield 28 need only confine quantity 16 of combustible material and solid oxidant in the recess prior to ignition. Whether shield 28 expands after ignition, or ruptures, the normal operation of lamp 27 remains unaffected.

A rigid, transparent, hollow enclosure 29 is secured at its open end to plate surface 12, by an adhesive, above recess 14. The volume of enclosure 29 is of sufficient magnitude to accommodate the gaseous oxygen and reaction products generated during combustion. Enclosure 29 is typically formed from a transparent sheet of polycarbonate resin, such as Lexan, or some other substantially rigid, transparent heat-resistant plastic.

In operation, when a sufficiently high potential is applied to leads 22 of primer 20, the ball of primer material 21 ignites the quantity of combustible material within recess 14, causing the release of radiant light energy and gaseous oxygen and reaction products. Shield 28, after ignition, either expands within the volume of enclosure 29 so as to allow the expanding volume to be occupied by burning metal and gaseous oxygen generated after ignition, or ruptures. Rupture of shield 28 does not affect the operation of photoflash lamp 27, as rigid enclosure 29 then serves to accommodate the burning volume occupied by the combustible mixture after ignition and provides a more lambertian source for maximum light emission.

Although not essential to the operation of the photoflash lamp embodiments shown in FIGS. 1–6, a reflective coating 32 may be applied to surface 12 or 13 of plate 11 as well as to the interior or exterior of recess 14, so as to reflect radiated light generated by the ignition of the combustible material.

While only certain preferred features of the invention have been shown by way of illustration, many modifications and changes will occur to those skilled in the art. It is, therefore to be understood that the appended claims are intended to cover all such modifications and changes as fall within the true spirit of the invention.

What is claimed is:

1. A photoflash lamp for providing an expandable volume to accommodate oxygen and reaction products generated upon combustion of a combustible mixture contained therein, comprising:

(a) plate means having a substantially flat surface on each side and one of said sides having a recess medially disposed therein;

(b) a combustible mixture substantially filling said recess;

(c) primer means overlying said plate surface and centrally disposed in the opening of said recess for igniting said combustible mixture; and (d) transparent, substantially flat plate expandable sealing means formed over said recess and affixed to said plate means surface for confining said combustible mixture within said recess, said sealing means expanding during combustion of said combustible mixture so as to define a volume between said sealing means and said plate means greater than the volume of said recess.

2. The invention according to claim 1 wherein said plate means comprises a laminar sheet of polycarbonate resin.

3. The invention according to claim 1 wherein said combustible mixture comprises a combustible metal and solid oxidant.

4. The invention according to claim 3 wherein said combustible metal comprises one of the group consisting of magnesium, aluminum, zirconium, hafnium and thorium.

5. The invention according to claim 3 wherein said solid oxidant consists essentially of one of a chlorate and a perchlorate.

6. The invention according to claim 1 wherein said transparent expandable sealing means comprises a laminar sheet of expandable resin formed over said recess and rigidly affixed about the periphery of said recess to provide an annular area of a diameter larger than the diameter of said recess capable of expansion away from said recess during combustion.

7. The invention according to claim 6 wherein said laminar sheet of expandable resin is expandable in response to heat generated by combustion of the quantity of combustible material contained within said recess.

8. The invention according to claim 6 wherein said laminar sheet is expandable in response to pressure generated by gaseous oxygen generated during combustion of the combustible material contained within said recess.

9. The invention according to claim 6 wherein said resin comprises one of the group consisting of polyethylene, polypropylene, and plasticized polyvinyl chloride.

10. The invention according to claim 1 further including a rigid transparent enclosure of predetermined volume joined to said surface of said plate means and formed over said transparent, expandable sealing means so as to provide a preselected burning volume.

11. The invention according to claim 10 wherein said rigid enclosure comprises a polycarbonate resin.

12. The invention according to claim 1 further including a reflective coating disposed on said recess and on said plate means surface for reflecting radiated light generated by combustion of the combustible mixture within said recess.

13. A photoflash lamp for providing a preselected burning volume to accommodate gases generated by the combustion of a combustible mixture contained therein comprising:

(a) a plate member having a recess medially disposed in one of said surfaces;

(b) combustible mixture substantially filling the volume of said recess;

(c) primer means overlying said plate means surface and centrally disposed in the opening of said recess for igniting said combustible mixture contained within said recess;

(d) transparent, substantially flat plate shield means affixed to said one surface adjacent to said recess opening for confining said combustible mixture in said recess; and (e) a rigid, hollow, transparent enclosure joined to said surface of said plate member adjacent to said recess opening, said enclosure containing a volume sufficient to accommodate the oxygen and reaction produced after ignition generated by the combustion of the combustible mixture contained within said recess.

14. The invention according to claim 13 further including a reflective coating disposed on said recess and one of said surfaces of said plate means for reflecting light generated by combustion of the combustible mixture contained within said recess.

* * * * *

UNITED STATES PATENT AND TRADEMARK OFFICE

CERTIFICATE OF CORRECTION

PATENT NO. : 4,233,023

DATED : November 11, 1980

INVENTOR(S) : Peter D. Johnson et al

It is certified that error appears in the above-identified patent and that said Letters Patent are hereby corrected as shown below:

Correct claim 13 as follows:

Column 6, line 14, after "member" insert -- having substantially flat surfaces on opposite sides and --

Column 6, line 30, delete "produced" and substitute therefor -- products --

Signed and Sealed this

*Twenty-third* Day of *February 1982*

[SEAL]

*Attest:*

GERALD J. MOSSINGHOFF

*Attesting Officer*

*Commissioner of Patents and Trademarks*